US011384488B2

(12) United States Patent
Neumann et al.

(10) Patent No.: US 11,384,488 B2
(45) Date of Patent: Jul. 12, 2022

(54) ARTICULATING ROLLING COMPACTOR ATTACHMENT

(71) Applicant: Road Widener LLC, Delafield, WI (US)

(72) Inventors: Duane A. Neumann, Jefferson, WI (US); Devin Wolf, Oconomowoc, WI (US); Michael Schutte, Ixonia, WI (US); Devery G. Beal, Iron Ridge, WI (US)

(73) Assignee: Road Widener LLC, Delafield, WI (US)

( * ) Notice: Subject to any disclaimer, the term of this patent is extended or adjusted under 35 U.S.C. 154(b) by 0 days.

(21) Appl. No.: 16/906,940

(22) Filed: Jun. 19, 2020

(65) Prior Publication Data

US 2020/0318296 A1 Oct. 8, 2020

Related U.S. Application Data

(63) Continuation of application No. 16/149,975, filed on Oct. 2, 2018, now Pat. No. 10,689,812, which is a (Continued)

(51) Int. Cl.

| | |
|---|---|
| ***E01C 19/26*** | (2006.01) |
| ***E01C 19/25*** | (2006.01) |
| ***E02F 3/36*** | (2006.01) |
| ***E02F 3/96*** | (2006.01) |
| ***E02D 3/039*** | (2006.01) |

(52) U.S. Cl.

CPC ..... *E01C 19/266* (2013.01); *E01C 19/25* (2013.01); *E01C 19/268* (2013.01); *E02D 3/039* (2013.01); *E02F 3/3695* (2013.01); *E02F 3/967* (2013.01); *E01C 19/26* (2013.01)

(58) Field of Classification Search

CPC ..... E01C 19/266; E01C 19/268; E01C 19/22; E01C 19/26; E01C 19/25; E01H 5/06; E01H 5/04; E02D 3/039; E02F 3/3695; E02F 3/967

See application file for complete search history.

(56) References Cited

U.S. PATENT DOCUMENTS 2,386,025 A 10/1945 Wills
2,541,045 A 2/1951 Ferwerda et al.
(Continued)

FOREIGN PATENT DOCUMENTS

CA 2712787 A1 2/2012

*Primary Examiner* — Abigail A Risic
(74) *Attorney, Agent, or Firm* — Reinhart Boerner Van Deuren P.C.

(57) ABSTRACT

A rolling compactor attachment configured for use with a host vehicle. The host vehicle has a front with a first side and a second side. The rolling compactor attachment includes an attachment plate configured to attach to the front of the host vehicle such that the attachment plate is stationary relative to the host vehicle. A boom includes a first end that coupled to the attachment plate. A roller is coupled to a second end of the boom. The boom is configured to position the roller laterally beyond at least one of the first side or the second side, and the roller is configured to tilt about the second end of the boom such that the roller is able to compact an inclined or declined slope.

18 Claims, 13 Drawing Sheets

Related U.S. Application Data continuation of application No. 15/319,543, filed as application No. PCT/US2015/067483 on Dec. 22, 2015, now Pat. No. 10,087,587.

(60) Provisional application No. 62/096,001, filed on Dec. 23, 2014.

(56) References Cited

U.S. PATENT DOCUMENTS

| | | | | |
|---|---|---|---|---|
| 3,072,025 | A | 1/1963 | Cronin | |
| 3,291,013 | A | 12/1966 | Stolp | |
| 3,394,641 | A | 7/1968 | Steck | |
| 3,732,996 | A | 5/1973 | Bauer | |
| 4,193,710 | A | 3/1980 | Pietrowski | |
| 5,304,013 | A * | 4/1994 | Parsons | E01C 19/266 404/127 |
| 5,395,182 | A | 3/1995 | Rossburger | |
| 6,345,932 | B1 | 2/2002 | Fix | |
| 6,612,774 | B1 | 9/2003 | Dulin | |
| 7,540,689 | B1 | 6/2009 | Major, Sr. | |
| 2007/0206993 | A1 * | 9/2007 | Tyhy | E01C 19/26 404/128 |
| 2008/0069639 | A1 | 3/2008 | James | |
| 2008/0267719 | A1 | 10/2008 | Corcoran | |
| 2010/0135724 | A1 | 6/2010 | Roth | |
| 2010/0278589 | A1 | 11/2010 | Verhoff | |
| 2012/0045281 | A1 | 2/2012 | Wagner | |
| 2013/0306338 | A1 | 11/2013 | Wood, Sr. | |
| 2017/0167087 | A1 | 6/2017 | Frelich | |

* cited by examiner

ARTICULATING ROLLING COMPACTOR ATTACHMENT

CROSS-REFERENCE TO RELATED PATENT APPLICATIONS

This patent application is a continuation U.S. patent application Ser. No. 16/149,975, filed Oct. 2, 2018, which is a continuation of U.S. patent application Ser. No. 15/319,543, filed Dec. 16, 2016, which is now U.S. Pat. No. 10,087,587, issued Oct. 2, 2018, which claims priority to PCT/US2015/067483, filed Dec. 22, 2015, which claims the benefit of U.S. Provisional Patent Application No. 62/096,001, filed Dec. 23, 2014, the entire teachings and disclosure of which are incorporated herein by reference thereto.

BACKGROUND OF THE INVENTION

Devices for road widening and creating shoulders are known in the road construction industry. During construction of roads and shoulders, the soil must be compacted in order to prevent settling. Soil compaction is relatively straight-forward on level surfaces, however; inclined surfaces present can be difficult to properly compact as the compactor may become unstable and topple and/or slide.

Another feature of known devices is that they are self-propelled. Many of the devices include large engines with transmissions for moving the devices. Some examples include drivable, rolling compactors. These devices add considerable transportation issues and costs to the project.

Additionally, the shoulder of a roadway often includes a pitch or slope away from the road. This slope helps drainage and ensures a safer roadway. The further the distance from the roadway, the steeper the pitch may be. There may also be hills to the side of a road with an increasing grade that requires compaction. In order to provide a proper foundation for the road, the entire shoulder and surrounding area need to be properly compacted.

Due to the positive or negative slope, conventional compaction equipment like the above-mentioned rolling compactors is known to topple and roll over. This can cause bodily harm and even death as compaction equipment varies in weight from a hundred pounds to thousands of pounds. It can also be expensive to transport and operate large equipment.

What is therefore needed in the road construction industry is a low-cost device that may be pushed by another vehicle such as a skid steer, thus eliminating the need for an engine and drivetrain. Also needed is a device that can compact the sloped shoulders of a roadway without the risk of tipping the vehicle. Another feature needed is a device that is constructed in a lightweight design, allowing for easier mobility, repairs, reduced costs, lower fuel consumption, and less maintenance.

SUMMARY AND OBJECTS OF THE INVENTION

A skid steer rolling compactor attachment may be formed from a universal attachment plate configured to attach to the skid steer. A boom may extend from the attachment plate and articulate/move in a plurality of axis with at least one hinge. The hinge(s) may allow a roller attached to the boom opposite the attachment plate to compact a ground surface to the side of the skid steer as the skid steer travels forward.

The skid steer rolling compactor attachment may further include a boom attached to the skid steer with at least one articulating hinge. The articulating hinge may be configured to allow the boom to articulate in at least one axis. A roller may be attached to the boom opposite the articulating hinge. The skid steer may be driven forward, or in any direction of travel. In order to compact the ground to the side of the skid steer, the roller may be moved to a side of the skid steer perpendicular to the direction of travel. The roller may then be lowered to contact a ground surface perpendicular to the direction of travel. The ground surface may then be compacted on the side of the skid steer as the skid steer is driven forward.

The invention may include one or more of the characteristics discussed above in various combinations, thus, allowing for a reduced labor time and labor effort when compacting ground on a job site. These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the constructions and operation of typical mechanisms provided with the present invention, will become more readily apparent by referring to the exemplary, and therefore non-limiting, embodiments illustrated in the drawings accompanying and forming a part of this specification, wherein like references numerals designate the same elements in the several views, and in which.

Figure 1:
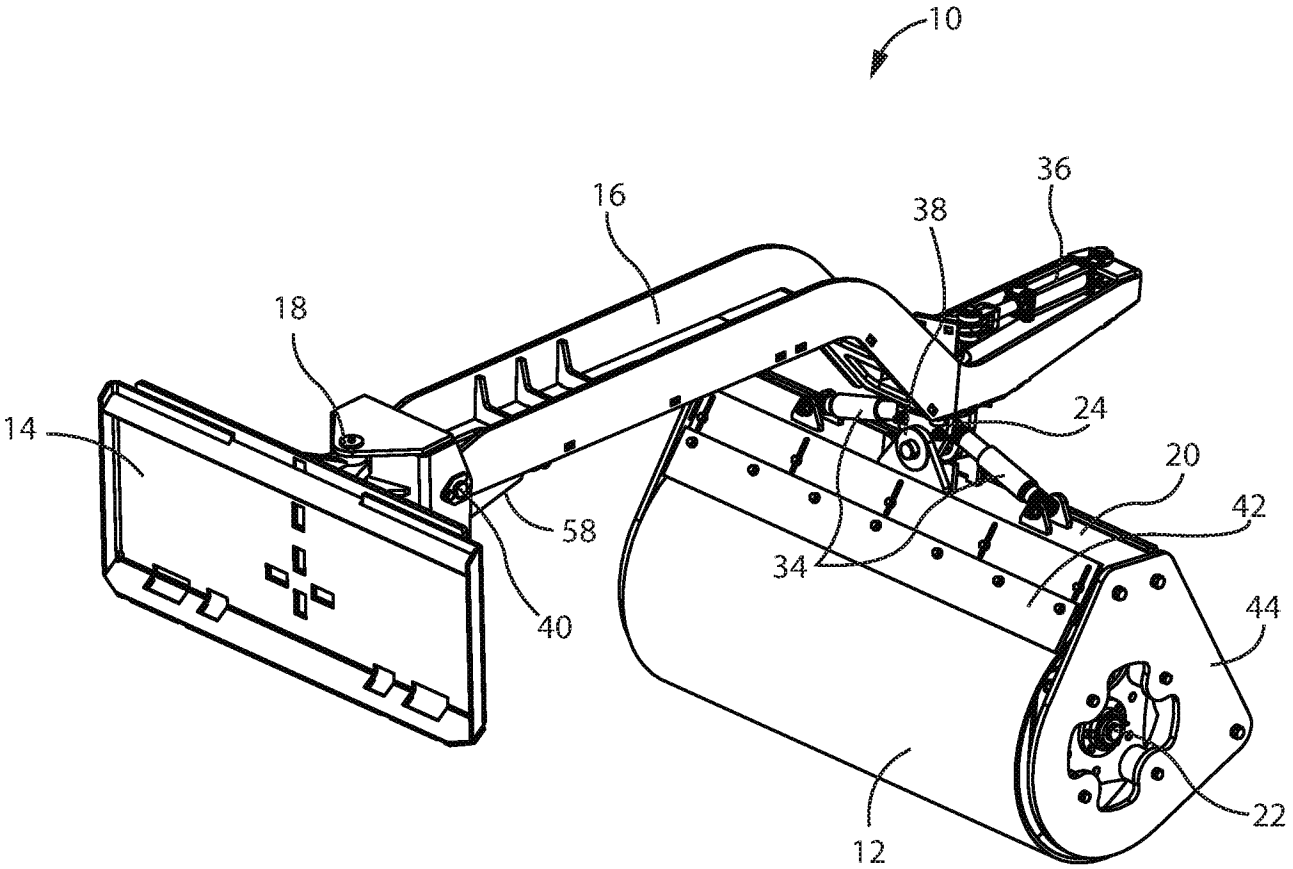
FIG. 1 is a perspective right side view of an inventive articulating rolling compactor attachment device, according to an embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF EMBODIMENTS

Skid steers are commonly used in construction sides as the power source for a number of attachments. As they are commonly used to move aggregate, dirt, or other debris, they are typically present during road construction. Skid steers are also considerably less expensive than other earth-moving construction equipment and for this reason they are preferable for use in road construction. For example, there are many ways to move a mound of gravel. In order to minimize costs and maximize profits companies routinely seek the most efficient way to get things done. In this example, a skid steer is typically the most economical way to move the gravel. An added benefit of the skid steer is that there are a number of attachments that can be attached to the skid steer. As a result, a single skid steer can be configured to perform the tasks of a number of different earth-moving equipment.

Figure 2:
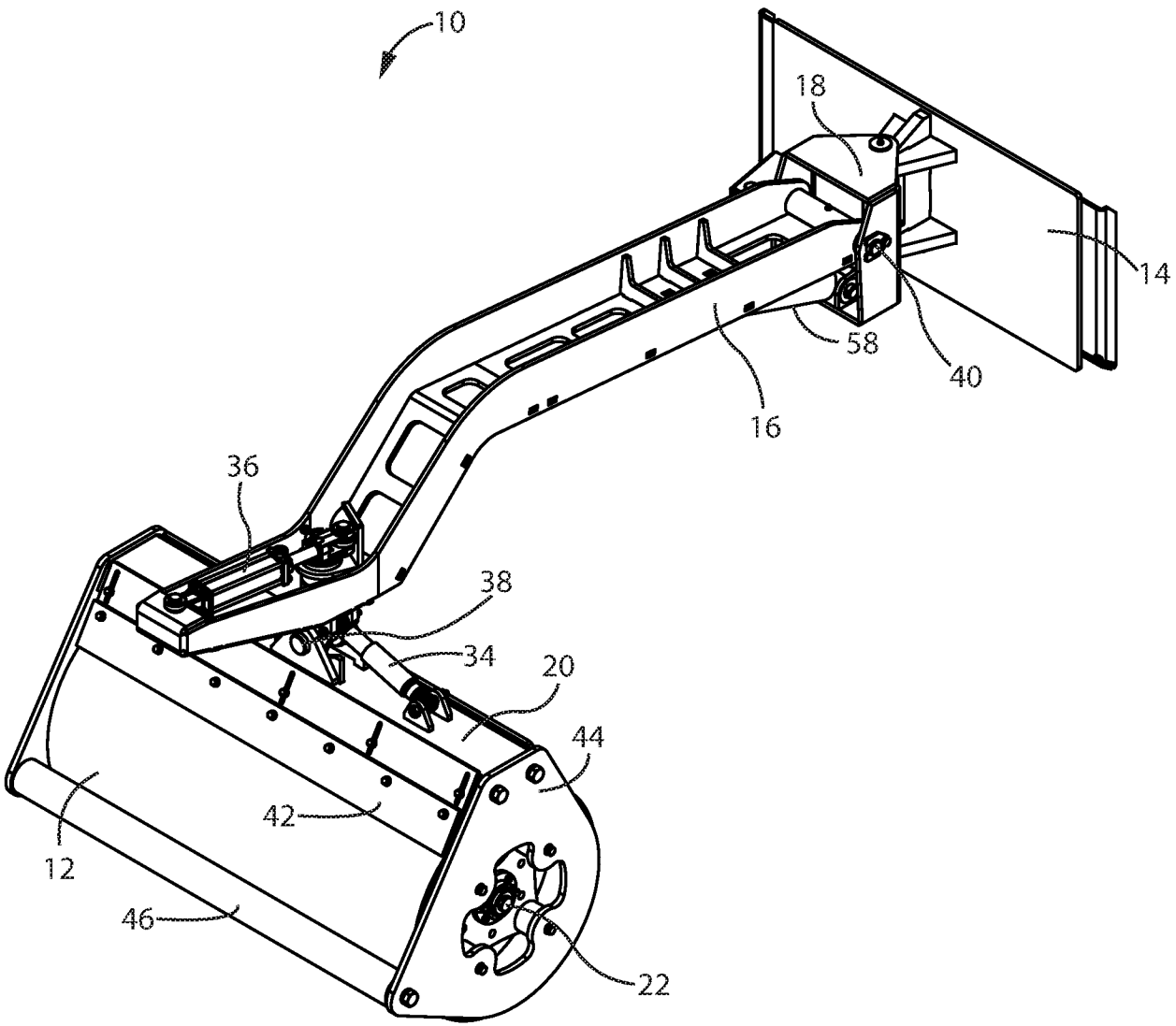
FIG. 2 is a perspective left side view of the articulating rolling compactor attachment device of FIG. 1.

The inventive skid steer attachment is shown in FIGS. 1-6. The articulating rolling compactor attachment 10 is configured for attachment to a skid steer 26 as specifically shown in FIGS. 6A and 6B. Referring to FIGS. 1 and 2, the attachment plate 14 may include any number of holes, bosses, fittings, or any other attachment device to connect to a skid steer. The attachment plate 14 is preferably constructed of a resilient material such as steel, but any other known material may be used. In order to provide a universal compatibility, the attachment plate 14 preferably has more than one attachment device so that it can attach to any number of unique skid steers 26. Alternatively, the attachment plate may connect to any vehicle, not just skid steers 26.

Regardless of the propulsion vehicle, the articulating rolling compactor attachment 10 may have independent controls that allow operation totally independent from the host vehicle. In such a configuration, the boom 16 may be operated to extend, pivot, spin, rotate, or articulate in any direction. It is to be understood pivot, twist, spin, turn, and the like all mean movement in any direction with respect to not only the boom but any part of the invention. The movement is not to be limited to only a certain type of movement in one axis but complete freedom of motion in all directions. Preferably the boom 16 will be hydraulically operated with an independent hydraulic assembly, but it may tap into the existing hydraulics of the host vehicle. Also, electronic actuators may be used to provide articulation power. A joystick or lever controller may also be employed to articulate the boom 16, whether independent or pre-existing on the host vehicle.

In the preferred embodiment, the boom 16 is attached to the attachment plate 14 about a pivot hinge 18 and a lift hinge 40. A lift cylinder 58 may be actuated from within the skid steer 26 to raise and lower the boom 16. A pivot cylinder 52, seen for example in FIG. 3, may also be actuated to cause the boom 16 to pivot about the pivot hinge 18.

On the opposing side of the boom, opposite the attachment plate 14, the roller 12 may twist about a twist hinge 24 with the use of a twist cylinder 36. The twist cylinder 36 is attached to the boom 16 and causes the roller 12 to twist about the twist hinge 24 when actuated. This twisting motion allows the roller 12 to be properly oriented alongside the skid steer so that it can properly compact the ground to the side of the skid steer.

An added joint may be included proximate the twist hinge 24 such as a tilt hinge 38. The tilt hinge 38 connects a frame 20 that supports the roller 12 to the boom 16. When a tilt cylinder 34 is actuated, it causes the frame 20 to tilt in one direction or the other. For added stability, a tilt cylinder 34 is attached to the frame 20 on each side of the boom 16. The tilt hinge 38 thus allows the roller 12 to pivot about the horizontal axis. The roller 12 is therefore allowed to pivot which enables compaction along an inclined slope as the skid steer 26 is driven forward along the adjacent level road. In this configuration, the skid steer 26 never needs to come in contact with the incline and can remain on the level road which promotes safety.

As previously mentioned, the roller 12 may also be suspended from the boom 16 by a frame 20. The frame 20 may cradle the roller 12 and attach to its central axis with bearings 22. The bearings 22 allow the roller 12 to roll without binding on the boom 16. While the roller 12 is rolling about the bearings 22, an adjustable scraper 42 may be inclined on each side of the roller 12. The adjustable scrapers 42 attach to the frame 20 and are positioned to scrape off any debris stuck onto the roller 12 as it rotates. A side plate 44 may also be attached on each side of the roller 12 to the frame 20 which protect the sides of the roller 12. A guide 46 may further stiffen the side plates 44 to provide structural rigidity to the frame 20.

Figure 3:
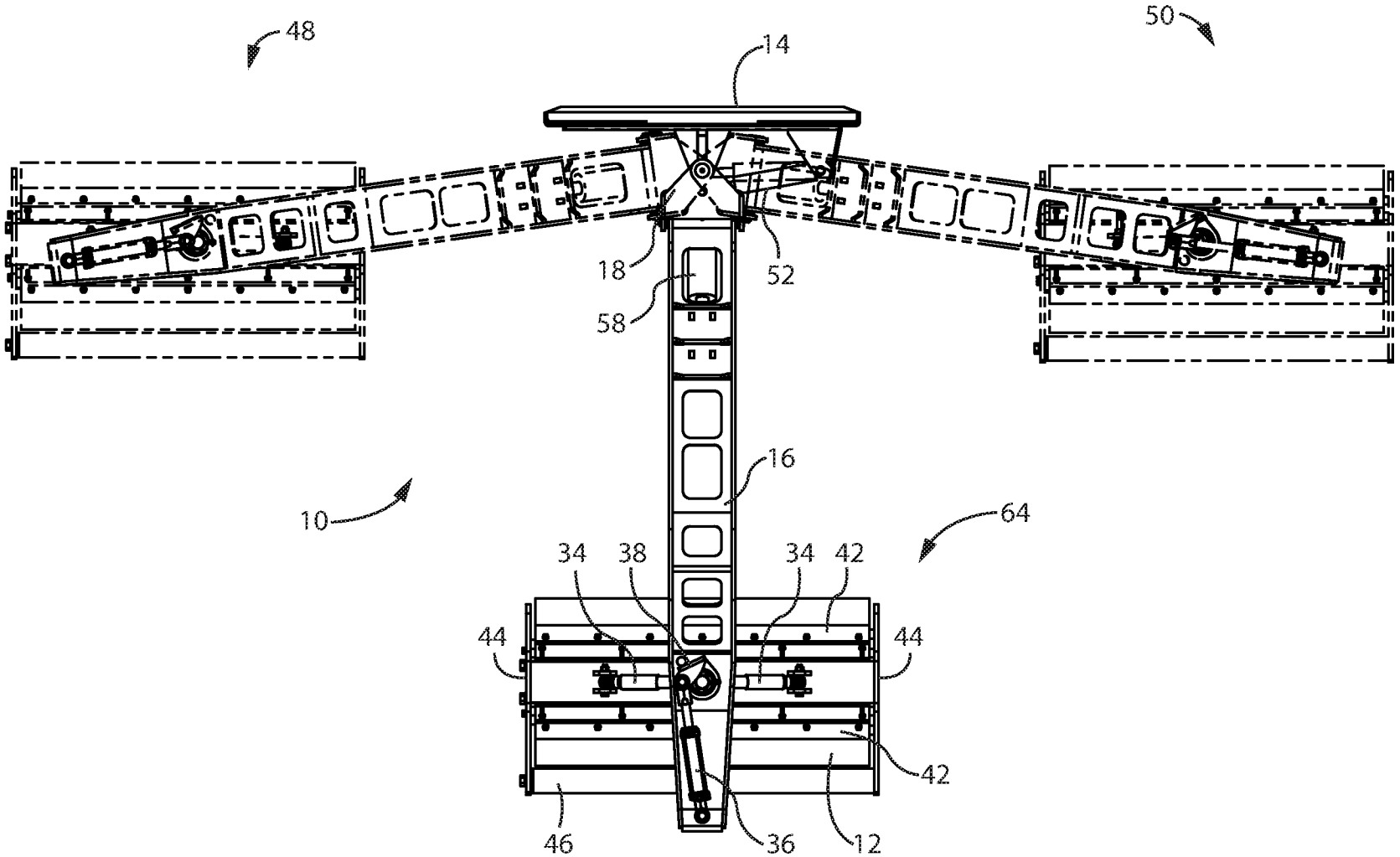
FIG. 3 is a top view of the articulating rolling compactor attachment device of FIG. 1 with the boom articulating side to side in various positions shown in ghost images.

Referring now to FIG. 3, when pivoting the boom 16 about the pivot hinge 18, the boom 16 may pivot to a fully turned right position 48, a centered position 64, and to a fully turned left position 50. The boom 16 may also be pivoted anywhere in between the respective fully turned positions. The pivot hinge 18 joins the boom 16 to the attachment plate and is powered by a pivot cylinder 52 which may be remotely actuated from within the skid steer 26. Regardless of the amount of articulating hinges, and regardless of the specific location of each hinge, the roller 12 may be placed in any desired location and oriented in any desired manner. The articulation allows the roller 12 to be placed above the host vehicle and also to the side of the vehicle. Similarly, the articulation allows the roller to be placed below the host vehicle and to the side.

Figure 4:
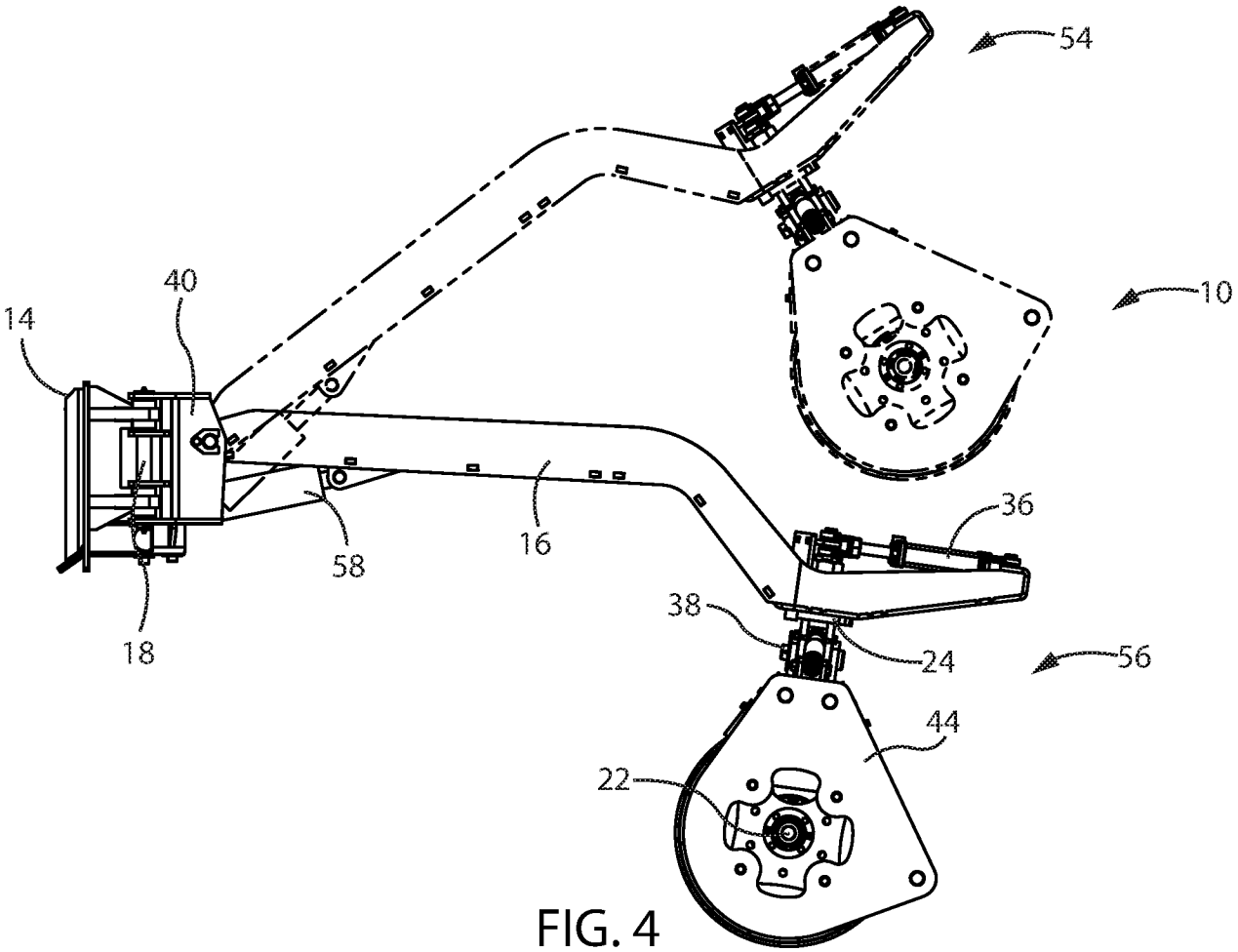
FIG. 4 is a side view of the articulating rolling compactor attachment device of FIG. 1 with the boom articulating up and down in various positions shown in ghost images.

As shown in FIG. 4, the boom 16 may also be lifted and lowered about the lift hinge 40 with a lift cylinder 58. The boom 16 may be raised to a fully raised position 54 and lowered to a fully lowered position 56 through remote actuation of the lift cylinder 58. This articulation allows for proper placement of the articulating rolling compactor attachment 10 on a sloped surface while keeping the skid steer 26 on a safe and level road.

Figure 5:
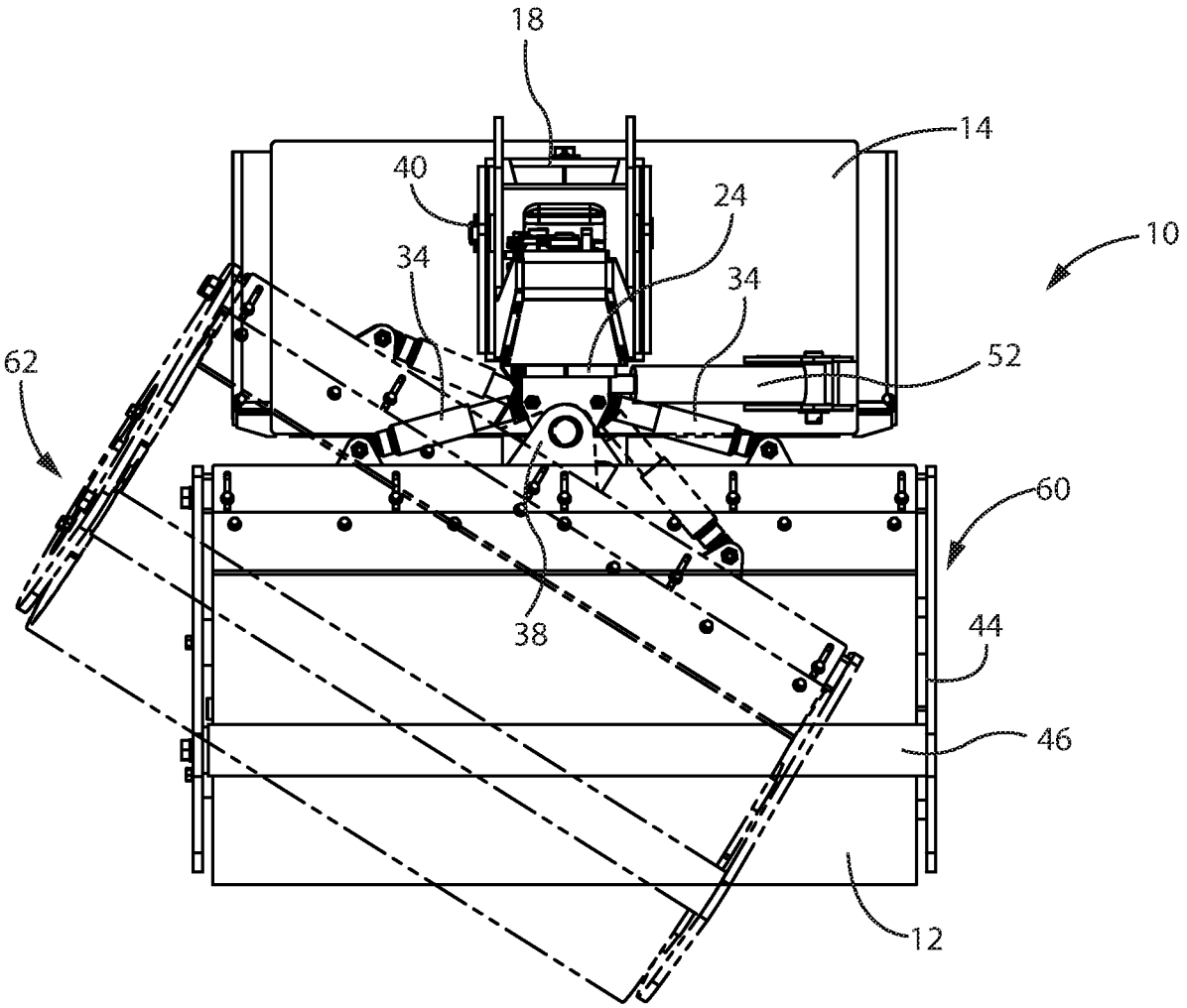
FIG. 5 is a front view of the articulating rolling compactor attachment device of FIG. 1 with the roller pivoting in a ghost image.

Moving on to FIG. 5, the articulating rolling compactor attachment 10 may be operated by actuating the tilt cylinders 34 such that the frame 20 and the supported roller 16 is tilted from a centered position 60 to a fully tiled position 62. While the roller 12 is shown tilted in a ghost image in only one direction, the plurality of tilt cylinders 34 allow the frame to tilt about the tilt hinge 38 in either direction. As previously discussed, this articulation allows for proper placement of the articulating rolling compactor attachment 10 on a sloped surface while keeping the skid steer 26 on a safe and level road.

Figure 6A:
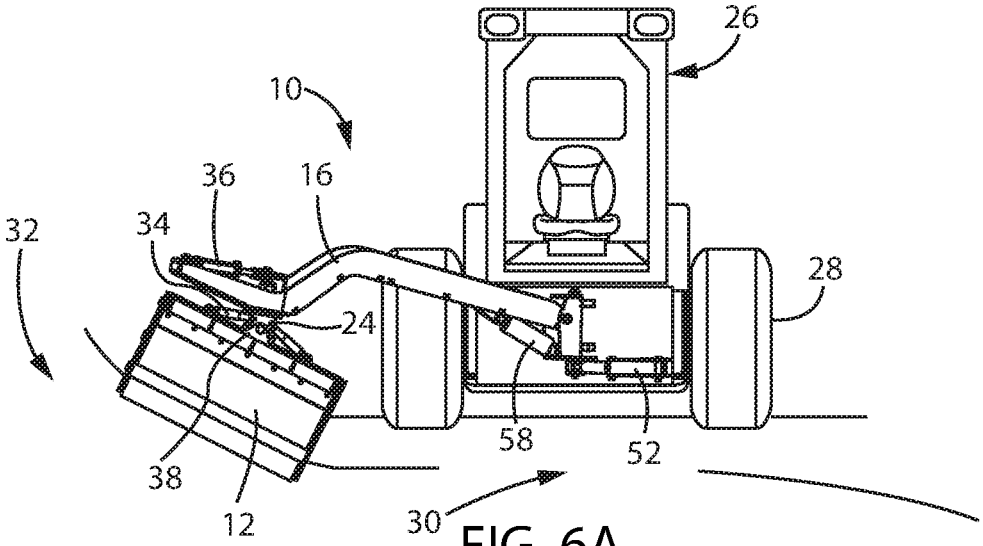
FIG. 6A is a rear view of a skid steer with the articulating rolling compactor attachment device of FIG. 1 attached and in operation.
Figure 6B:
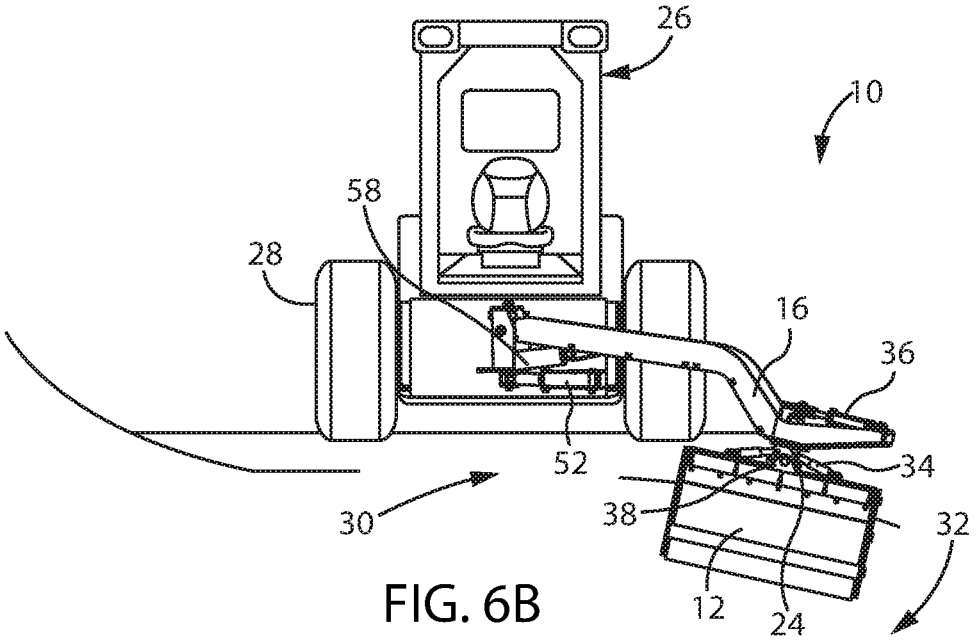
FIG. 6B is a rear view of a skid steer with the articulating rolling compactor attachment device of FIG. 1 attached and in operation.

As is shown in FIGS. 6A and 6B, the boom 16 may be articulated to place the roller 12 to the side of the skid steer 26 to compact the ground on the included slope 32 and eliminate the danger of a roll-over. Known rolling compactors would normally be driven directly on the inclined slope 32 and thus be prone to toppling over and causing injury to workers. Skid steer attachment devices also require the skid steer to be driven on the inclined surface.

FIG. 6A indicates an inclined slope 32 with a positive incline, the boom 16 may also articulate for a negative slope as shown in FIG. 6B or centered for a level road 30. The inventive articulating rolling compactor 10 may pivot the boom 16 about the pivot hinge 18 such that it is at an approximately 90 degrees to the front portion of the skid steer 26. The roller 12 may then be twisted about the twist hinge 24 to place the central, longitudinal axis of the roller, or the bearing 22 axis perpendicular to the side of the skid steer 26 as is shown. In this orientation the roller 12 may be in contact with the inclined slope 32 to the side of the skid steer 26 while the skid steer 26 is driven on the level road 30 in a forward direction. An additional benefit is that the wheels 28, or tracks, of the skid steer 26 may remain in contact with the relatively flat and level road 30 while compacting the inclined slope 32 to the side. The skid steer 26 may then drive forward and parallel to the inclined slope 32 while compacting at the same time.

The roller 12 may include any known compaction roller such as a water-filled drum. Alternatively, the roller may include a vibration system within the drum. The boom 16 may also be adjusted such that a predetermined amount of pressure is applied to the inclined slope 32 ensuring adequate compaction with minimal strain on the boom 16. Monitoring the pressure also ensures that the downward force from the boom 16 does not cause the skid steer 26 to topple. It is also envisioned that counterweights or ballast may be added to the skid steer 26 to further inhibit toppling.

It is also envisioned that the articulating rolling compactor 10 cam be attached to any vehicle, not just a skid steer 26. For example, it is envisioned that the articulating rolling compactor 10 may be attached to a traditional drivable rolling compactor allowing the operator to compact the level road 30 surface and the inclined slope 32 at the same time.

Figure 7:
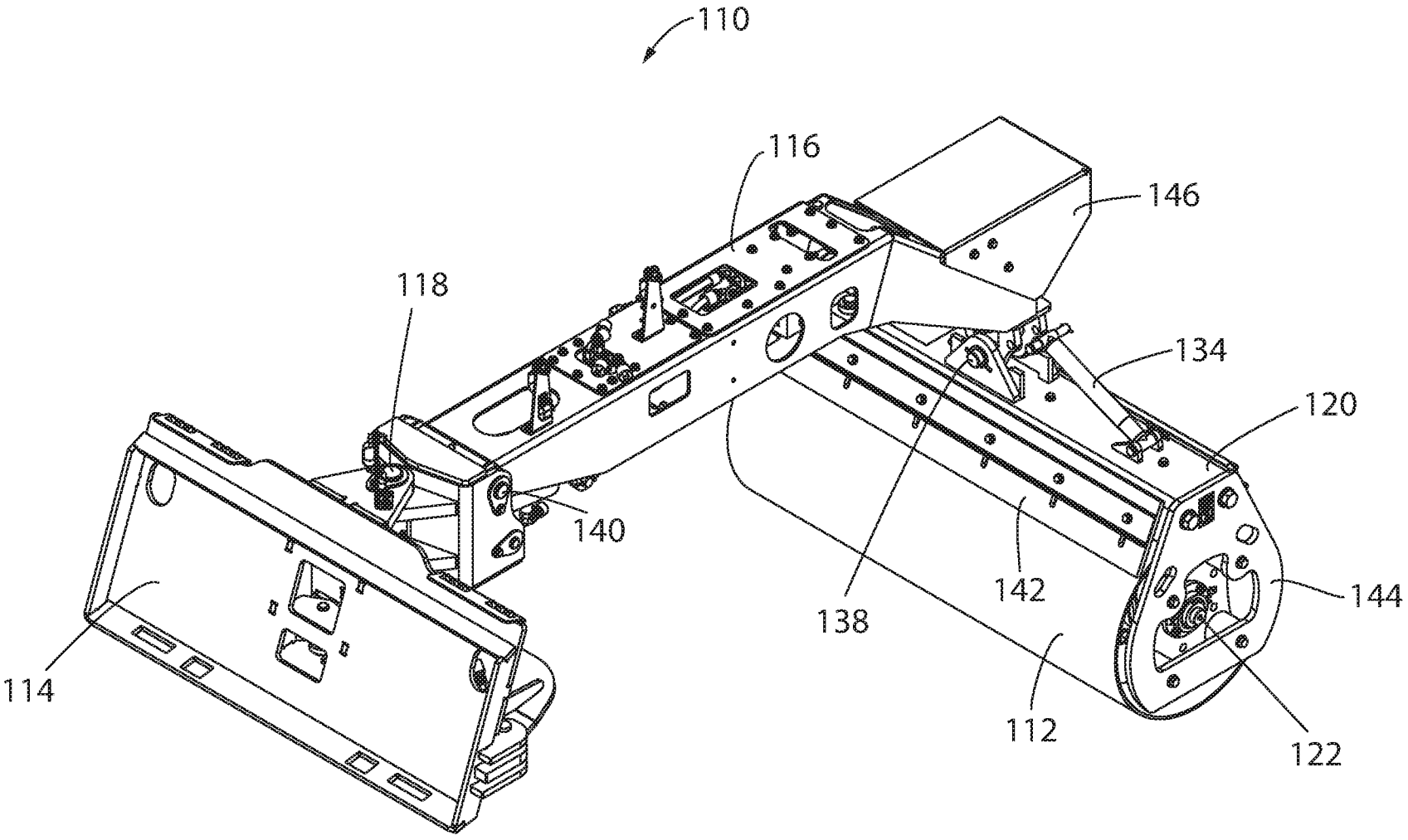
FIG. 7 is a perspective right side view of an inventive articulating rolling compactor attachment device, according to another embodiment of the invention.
Figure 8:
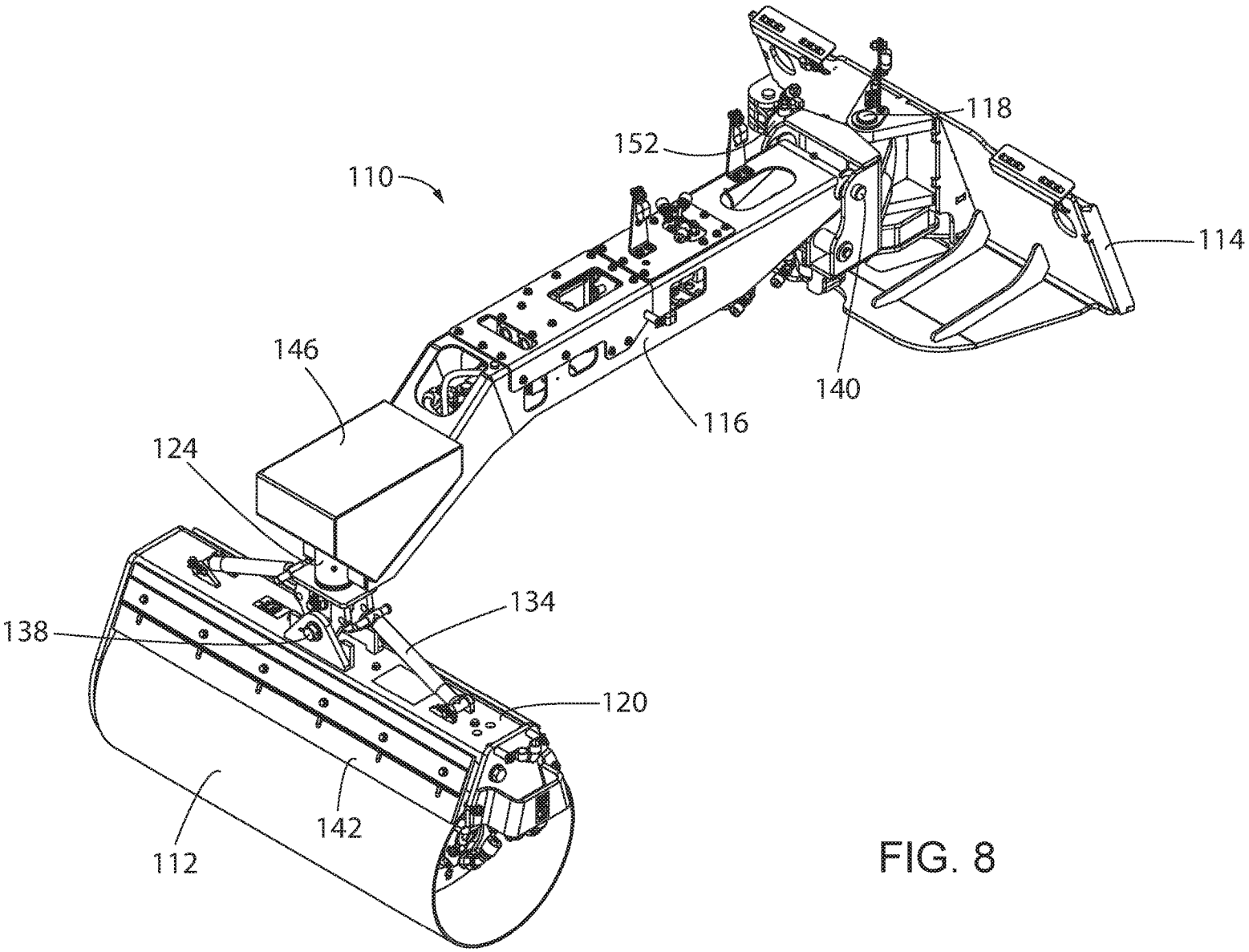
FIG. 8 is a perspective left side view of the articulating rolling compactor attachment device of FIG. 7.

Referring next to FIGS. 7-12, an articulating rolling compactor 110 is shown according to another embodiment of the invention. The articulating rolling compactor attachment 110 is designed to attach to a skid steer 126 via an attachment plate 114, which is further shown in FIGS. 12A and 12B. As shown in FIGS. 7 and 8, the attachment plate 114 may include any number of holes, bosses, fittings, or any other attachment devices in order to couple with the skid steer 126. The attachment plate 114 is constructed from a resilient material such as steel, but other known materials may also be used in other embodiments of the invention. In order to be universally compatible with the variety of skid steers on the market, the attachment plate 114 may include more than one attachment device in order to be attached to any skid steer 126.

In addition, the attachment plate 114 may be coupled to any vehicle, not just a skid steer. In addition, the attachment plate 114 may be oriented at an angle from vertical. For example, the attachment plate 114 may be oriented forward at 10 degrees from vertical in order to tilt the attachment plate 114 forward 10 degrees. In other embodiments of the invention, the attachment plate 114 may be tilted more or less than 10 degrees in either the forward or rearward direction. By orienting the attachment plate 114 at a forward angle, the attachment plate 114 becomes easier to couple and decouple from the skid steer 126. Further, the range of motion vertical range of motion of the articulating rolling compactor attachment 110.

The articulating rolling compactor attachment 110 may include independent controls that allow operation independent from the host vehicle 126. In such a configuration, a boom 116 may be operated to pivot, spin, rotate, and/or articulate in any direction. The terms pivot, twist, spin, turn, and the like may mean movement in any direction with respect to not only the boom, but any part of the invention. The movement is not limited to only a certain type of movement in one axis but complete freedom of motion in all directions. The boom 116 may be hydraulically operated with an independent hydraulic assembly. On the other hand, it is contemplated that the boom 116 may tap into the existing hydraulics of the host vehicle 126. Electronic actuators may also be used to provide articulation power. A joystick, lever controller, or a plurality of pushbuttons may also be used to articulate the boom 116, either independently or preexisting on the host vehicle 126.

In the embodiment shown in FIGS. 7-12, the boom 116 is attached to the attachment plate 115 about a pivot hinge 118 and a lift hinge 140. A hydraulic lift cylinder 158 may be actuated from within the skid steer 126 to move the boom 116 about the lift hinge 140 in order to raise and lower the boom 116. Similarly, a hydraulic pivot cylinder 152 may be actuated to cause the boom 116 to move about the pivot hinge 118 in order to move the boom 116 side to side, as further shown in FIG. 9.

On the side of the boom 116 opposite the attachment plate 114, a roller 112 is coupled to the boom 116 about a twist hinge 124 and a tilt hinge 138. A hydraulic twist cylinder 136 may be actuated from within the skid steer 126 to twist the roller 112 about the twist hinge 124. The twisting motion allows the roller 112 to be properly oriented alongside the skid steer 126 so that it can properly compact the ground to the side of the skid steer 126. A hydraulic tilt cylinder 134 may be actuated from within the skid steer 126 to tilt the roller 112 about the tilt hinge 138 in one direction or the other. The tilt hinge 136 thus allows the roller 112 to pivot about the horizontal axis to enable compaction along an inclined slope as the skid steer 126 is driven forward along the adjacent level road.

The roller 112 may also be suspended from the boom 116 by a frame 120. The frame 120 may cradle the roller 112 and attach to its central axis with bearings 122. The bearings 122 allow the roller 112 to roll without binding on the boom 116. While the roller 112 is rolling about the bearings 122, an adjustable scraper 142 may be included on one or both sides of the roller 112. That is, while FIGS. 7-8 depict the scraper 142 as being located on both sides of the roller 112, it may be located on only the front side of the roller 112, only the back side of the roller 112, or both sides of the roller 112. The adjustable scraper 142 may be attached to the frame 120 and positioned in order to scrape of any debris stuck onto the roller 112 as it rotates. A side plate 144 may also be attached to the frame 120 on either end of the roller 112 in order to protect the sides of the roller 112. White FIGS. 7-8 depict the side plate 144 as being disposed on the right end of the roller 112, it is contemplated that the side plate 144 may be located on either the right end, the left end, or both ends of the roller 112.

Figure 9:
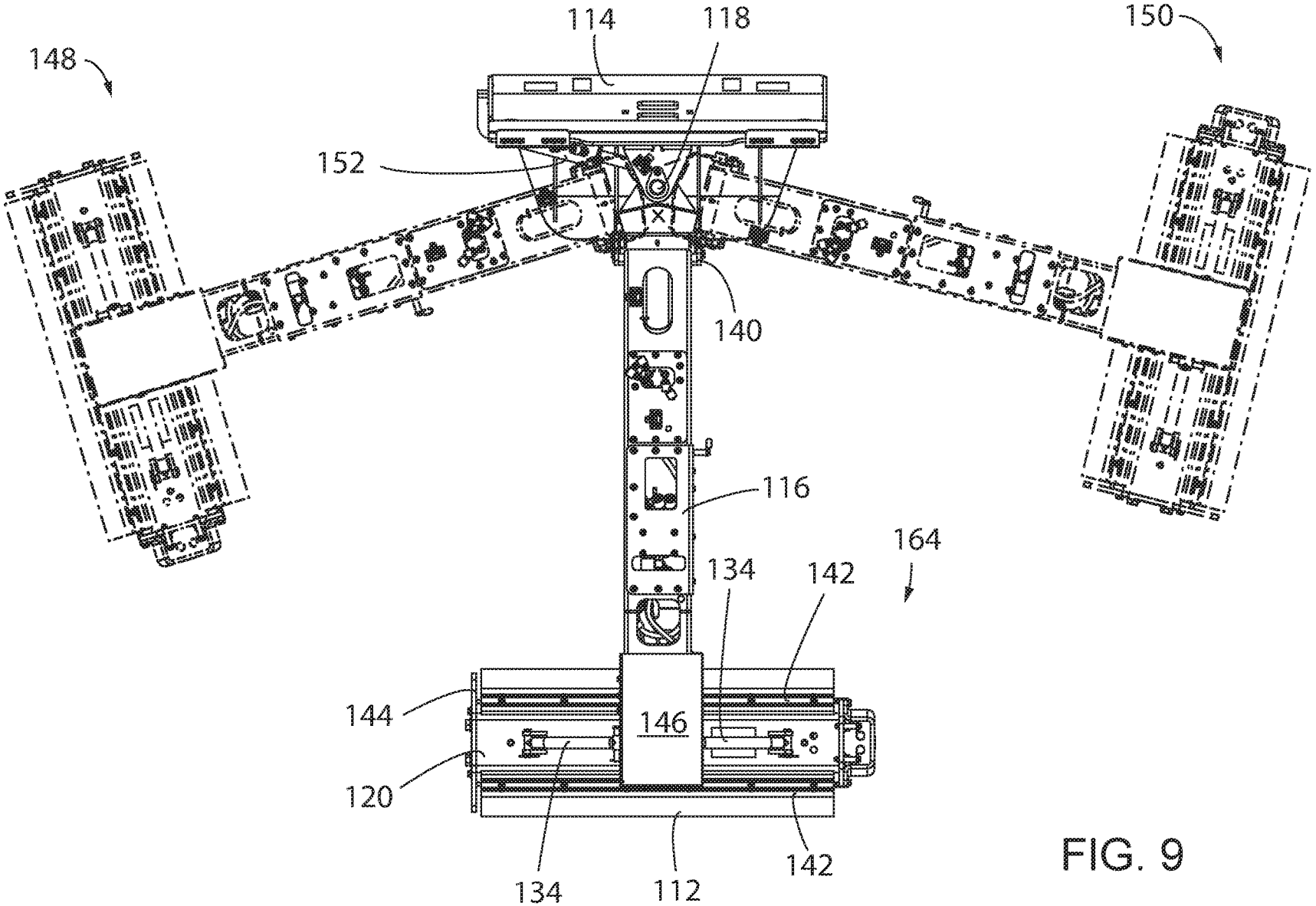
FIG. 9 is a top view of the articulating rolling compactor attachment device of FIG. 7 with the boom articulating side to side in various positions shown in ghost images.

Referring now to FIG. 9, the boom 116 may be pivoted side to side about the pivot hinge 118. The boom 116 may pivot to a fully turned right position 148, a centered position 164, a fully turned left position 150, and any location in between. The pivot hinge 118 joins the boom 116 to the attachment plate 114 and is powered by the pivot cylinder 152, which may be remotely actuated from within the skid steer 126. This articulation allows the roller 112 to be placed to either side of the host vehicle 126.

Figure 10:
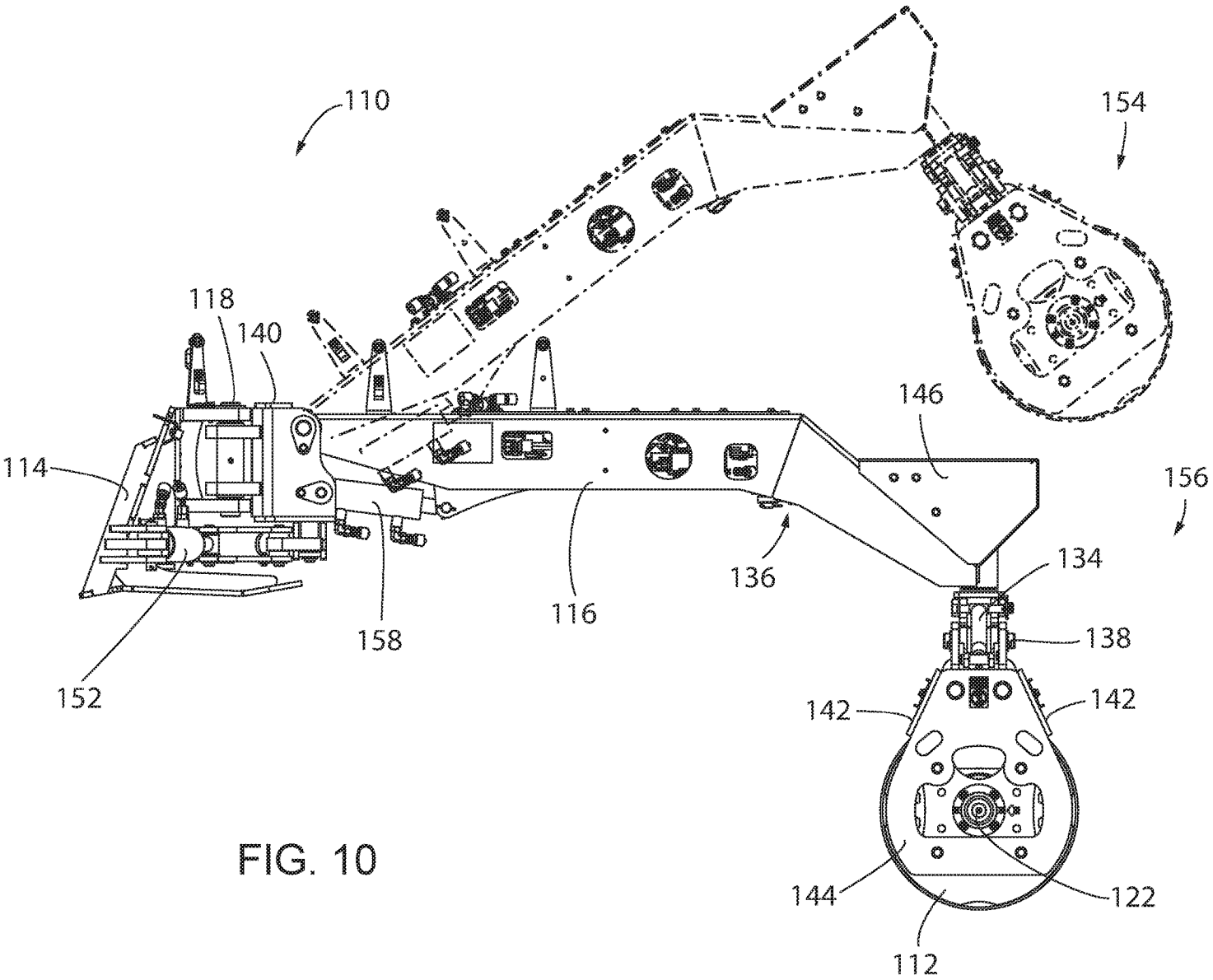
FIG. 10 is a side view of the articulating rolling compactor attachment device of FIG. 7 with the boom articulating up and down in various positions shown in ghost images.

As shown in FIG. 10, the boom 116 may be lifted and lowered about the lift hinge 140 by the lift cylinder 158. The boom 116 may be raised to a fully raised position 154, lowered to a fully lowered position 156, or placed at any location in between through remote actuation of the lift cylinder 158. This articulation allows the roller 112 to be placed above or below the host vehicle 126. In turn, the roller 112 is able to be placed in contact with a surface above or below the safe and level road upon which the host vehicle 126 is situated.

Figure 11:
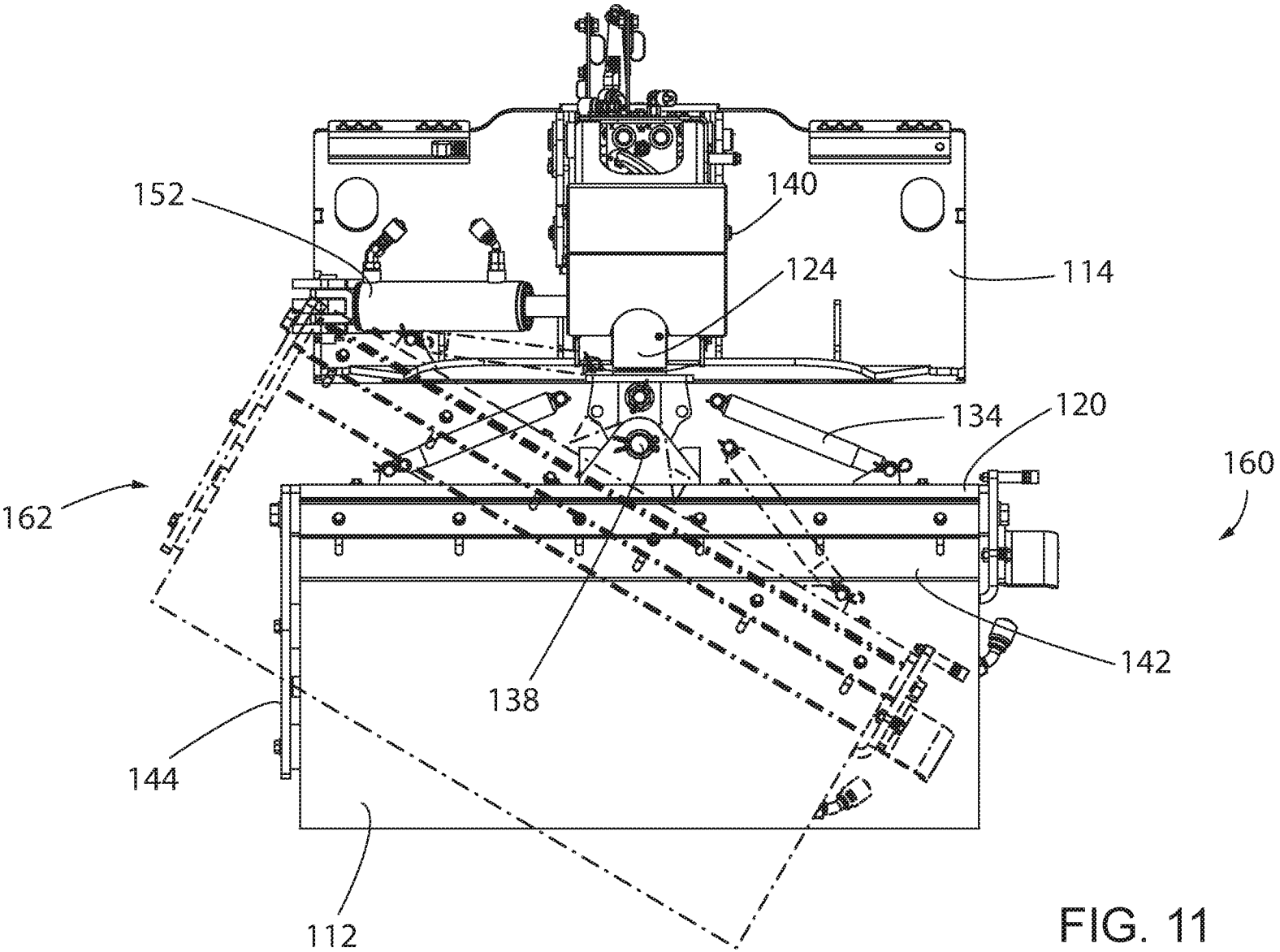
FIG. 11 is a front view of the articulating rolling compactor attachment device of FIG. 7 with the roller pivoting in a ghost image.

Next, FIG. 11 shows the roller 112 and frame 120 being tilted about the tilt hinge 138 by actuating the tilt cylinder 134. The frame 120 and roller 112 may be tilted from a centered position 160 to a fully tilted position 162 and anywhere in between. While the roller 112 is shown tilted in a ghost image in only one direction, the roller 112 is able to tilt about the tilt hinge 138 in either direction. This articulation allows for proper placement of the articulating rolling compactor attachment 10 on a sloped surface while keeping the skid steer 126 on a safe and level road.

Figure 12A:
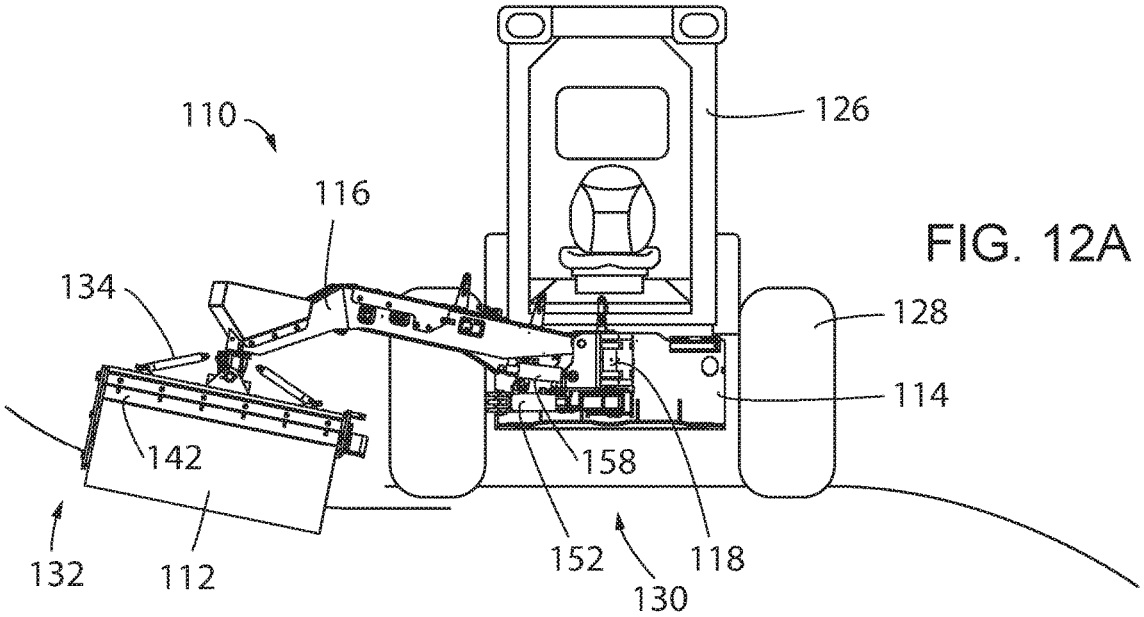
FIG. 12A is a rear view of a skid steer with the articulating rolling compactor attachment device of FIG. 7 attached and in operation.
Figure 12B:
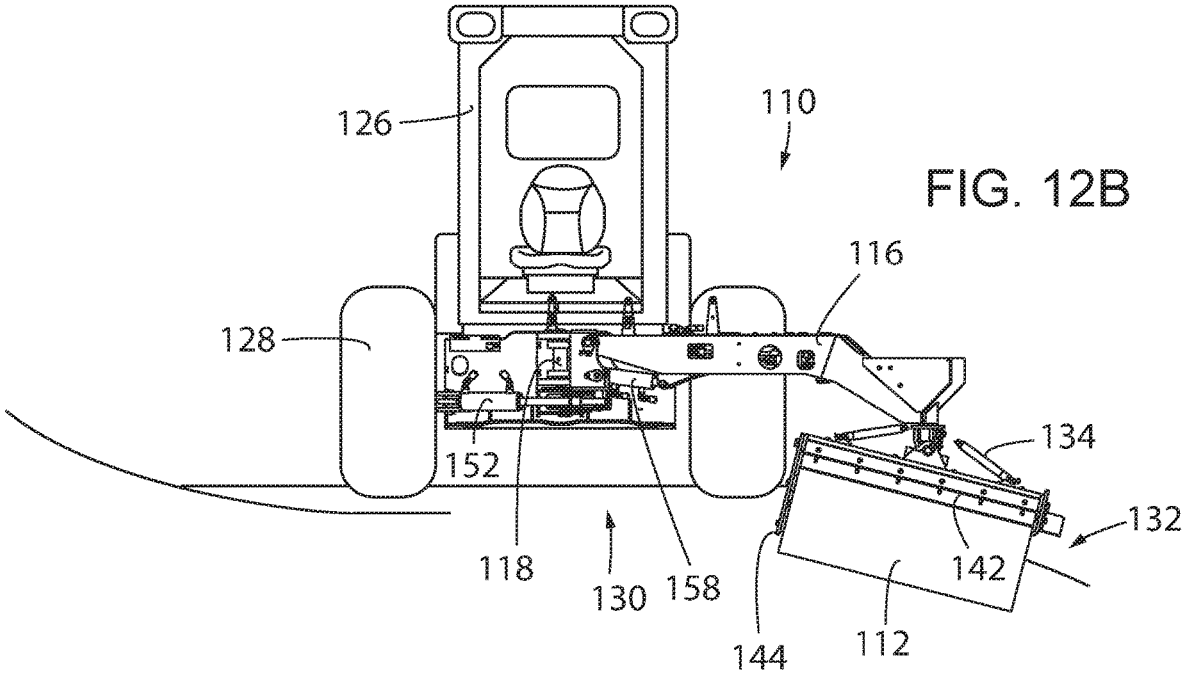
FIG. 12B is a rear view of a skid steer with the articulating rolling compactor attachment device of FIG. 7 attached and in operation.

FIGS. 12A and 12B further depict the articulating rolling compactor attachment 110 in use. The boom 116 may be articulated to place the roller 112 to the side of the skid steer 126 to compact the ground on the angled slope 132 and eliminate the danger of a roll-over. That is, the skid steer 126 need not be drive directly on the angled slope 132, which reduces the risk of toppling over and causing injury to workers.

FIG. 12A depicts the angled slope 132 with an incline, while FIG. 12B depicts the angled slope 132 with a decline. The articulating rolling compactor 110 may pivot the boom 116 about the pivot hinge 118 such that it is at an approximately 90 degrees to the front portion of the skid steer 126. The roller 112 may the be twisted about the twist hinge 124 to place the central, longitudinal axis of the roller, or the bearings 22 axis perpendicular to the side of the skid steer 126 as is shown. In this orientation, the roller 112 may be in contact with the angled slope 132 to the side of the skid steer 126, while the skid steer 126 is driven on the level road 130 in a forward direction. An additional benefit is that the wheels 128 or tracks of the skid steer 126 may remain in contact with the relatively flat and level road 130 while compacting the angled slope 132 to the side. The skid steer 126 may then drive forward and parallel to the angled slope 132 while compacting the same.

The roller 112 may include any known compaction roller such as a water-filled drum. Alternatively, the roller 12 may include a vibration system within the drum to assist in compacting. The boom 116 may also be adjusted such that a predetermined amount of pressure is applied to the angled slope 132 ensuring adequate compaction with minimal strain on the boom 116. Monitoring the pressure also ensures that the downward force from the boom 116 does not cause the skid steer 126 to topple. It is also envisioned that counterweights or a ballast may be added to the skid steer 126 to further inhibit toppling.

As shown in FIGS. 7-12, the boom 116 may be in the form of a hollow tube with a plurality of walls, as oppose to the u-shape boom 16 shown in FIGS. 1-6. While the representative embodiment of the invention depicts the boom 116 as having four (4) walls, the boom 116 may include any number of walls to form the hollow tube structure. This design results in improved fortification of the design and protection of the hydraulic and hinge components of the articulating rolling compactor 10. For instance, the hydraulic lines may be run through the interior of the hollow tube structure and, therefore, be protected from environmental elements. In addition, the boom 116 may include a cover 146 disposed opposite the attachment plate 114 to protect hydraulic and hinge components at the distal end of the boom 116, such as the twist hinge 124 and twist cylinder 136.

In varying embodiments of the invention, the hydraulic pivot cylinder 152, the hydraulic lift cylinder 158, the hydraulic tilt cylinder 134, and the hydraulic twist cylinder 136 may be prioritized over other systems, such as motor systems. As a result, response time of the hydraulic cylinders is minimized, which allows for immediate response of the hydraulic cylinders to commands.

Further, the hydraulic lift cylinder 158 may include a counter balance valve in order to maintain control of the down pressure of the roller 112. In particular, the counter balance allows the hydraulic lift cylinder 158 to maintain pressure to prevent the boom 116 from moving upward when the roller 112 is pushed into the ground to compact the ground surface.

Varying embodiments of the invention may use other host vehicles 126, not just a skid steer. For example, it is envisioned that the articulating rolling compactor 110 may be attached to a traditional drivable rolling compactor allowing the operator to compact the level road 130 surface and the angled slope 132 at the same time.

Figure 13:
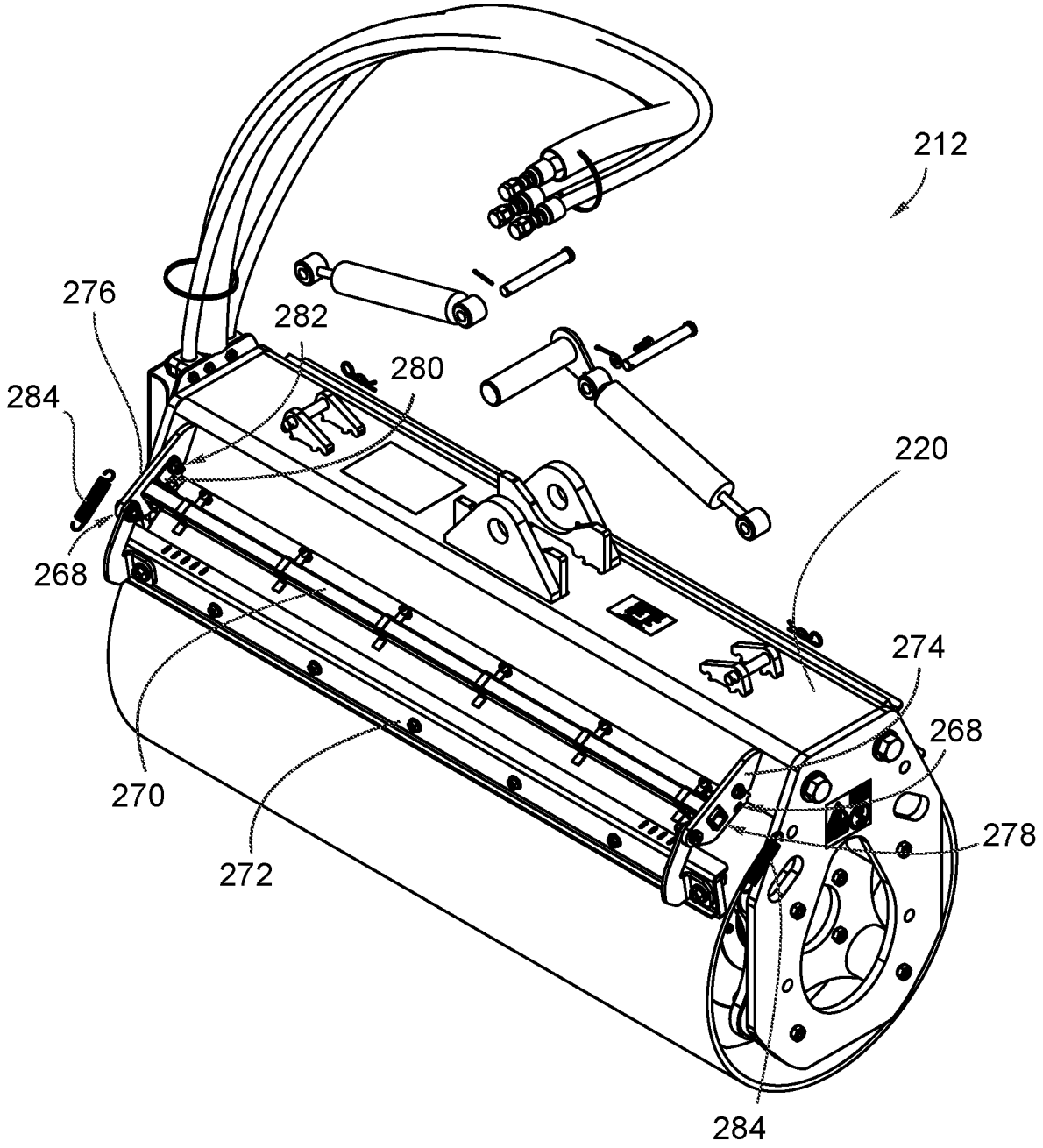
FIG. 13 depicts an embodiment of a roller having an external mount for a spray bar.

FIG. 13 depicts an embodiment of a roller 212 that can be used with any of the foregoing embodiments of the roller compacter attachment 10, 110 shown in FIGS. 1-12. As shown in the schematic, partially exploded view of FIG. 13, the roller 212 includes an external mount 268 for a spray bar 270. A plurality nozzles can be clipped to spray bar 270 so that water can be sprayed onto the drum of the roller 212 through such nozzles. A water reservoir feeding the spray nozzles may be carried by the host vehicle 26, 126 (shown in FIGS. 6 and 12) or on the roller compacter attachment 10, 110 (shown in FIGS. 1-12). Advantageously, a roller 212 configured to include spray nozzles can be used for asphalt applications in which water from the spray nozzles is used to prevent the asphalt from sticking to the drum and damaging the newly rolled asphalt mat. Thus, providing the external mount 268 allows for incorporation of a spray bar 270 so that the roller compacter attachment 10, 110 is better suited for asphalt applications. Further, the external mount 268 is positioned proximal to a scraper bar 272. The scraper bar 272 also helps to keep the drum free of material buildup, and by positioning the external mount 268 proximal to the scraper bar 272, water can be held between the scraper bar 272 and the drum of the roller 212 to keep the drum clean and lubricated.

As can also be seen in FIG. 13, the external mount 268 includes a first sidewall 274 and a second sidewall 276 attached to the frame 220 of the roller 212. The sidewalls 274, 276 include apertures 278 through which the spray bar 270 can be inserted. One or more brackets 280 secured with a fastener 282 can be used to keep the spray bar 270 in place. It should be noted that a variety of different third-party spray bars may be used with the disclosed external mount 268, and the particular depiction of the spray bar 270 should not be construed as limiting. In embodiments, the scraper bar 272 is also mounted to the external mount 268. As can be seen, each end of the scraper bar 272 is rotatably coupled to the external mount 268, and springs 284 provide tension on the scraper bar 272 to keep it in contact with the drum of the roller 212.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A rolling compactor attachment configured for use with a host vehicle, the host vehicle having a front with a first side and a second side, the rolling compactor attachment comprising:

an attachment plate configured to attach to the front of the host vehicle such that the attachment plate is stationary relative to the host vehicle;

a boom comprising a first end coupled to the attachment plate; and a roller coupled to a second end of the boom through a frame, the frame attached to opposite sides of a bearing extending along a central axis of the roller;

wherein the boom is configured to position the roller laterally beyond at least one of the first side or the second side;

wherein the roller is configured to tilt about the second end of the boom such that the roller is able to compact an inclined or declined slope;

wherein the roller is further configured to twist about the second end of the boom via a twist hinge coupling the frame of the roller to the boom, wherein a twist actuator is configured to move the roller about the twist hinge.

2. The rolling compactor attachment according to claim 1, further comprising a pivot hinge and a lift hinge coupling the boom to the attachment plate.

3. The rolling compactor attachment according to claim 2, further comprising a lift actuator coupled to the attachment plate and the boom, wherein the lift actuator is configured to move the boom about the lift hinge.

4. The rolling compactor attachment according to claim 3, wherein the lift actuator comprises a lift cylinder.

5. The rolling compactor attachment according to claim 4, wherein the lift cylinder is hydraulically actuated.

6. The rolling compactor attachment according to claim 3, wherein the lift actuator is configured to be remotely controlled from within the host vehicle.

7. The rolling compactor attachment according to claim 2, further comprising a pivot actuator coupled to the attachment plate and the boom, wherein the pivot actuator is configured to move the boom about the pivot hinge.

8. The rolling compactor attachment according to claim 7, wherein the pivot actuator comprises a pivot cylinder.

9. The rolling compactor attachment according to claim 8, wherein the pivot cylinder is hydraulically actuated.

10. The rolling compactor attachment according to claim 7, wherein the pivot actuator is configured to be remotely controlled from within the host vehicle.

11. The rolling compactor attachment according to claim 1, wherein the twist actuator comprises a twist cylinder.

12. The rolling compactor attachment according to claim 11, wherein the twist cylinder is hydraulically actuated.

13. The rolling compactor attachment according to claim 1, wherein the twist actuator is configured to be remotely controlled from within the host vehicle.

14. A method, comprising:

moving a host vehicle along a path having a substantially flat slope, the host vehicle having a front with a first side and a second side;

positioning a roller beyond the first side or the second side of the host vehicle, wherein the roller is coupled to the host vehicle through a boom and an attachment plate, the attachment plate attached to the front of the host vehicle;

compacting a surface having an inclined or declined slope relative to the path;

wherein positioning further comprises twisting the roller about a twist hinge coupling the roller to the boom.

15. The method according to claim 14, wherein positioning further comprises pivoting the boom about a pivot hinge coupling the boom to the attachment plate such that the roller is positioned beyond the first side or the second side.

16. The method according to claim 15, further comprising tilting the roller parallel to the inclined or declined slope of the surface.

17. The method according to claim 16, further comprising controlling the pivoting remotely within the host vehicle.

18. The method according to claim 14, wherein the host vehicle is a skid steer.

* * * * *